US007124569B2

(12) United States Patent
Lee et al.

(10) Patent No.: US 7,124,569 B2
(45) Date of Patent: Oct. 24, 2006

(54) TEXTURED YARN WITH DIFFERENT SHRINKAGE AND EXCELLENT SUEDE EFFECT AND METHOD FOR PREPARING THE SAME

(75) Inventors: Jeong-Gi Lee, Kyungsangbuk-do (KR); Chang-Bae Lee, Kyungsangbuk-do (KR); Yang-Soo Park, Kyungsangbuk-do (KR)

(73) Assignee: Kolon Industries, Inc., Kwacheon (KR)

( * ) Notice: Subject to any disclaimer, the term of this patent is extended or adjusted under 35 U.S.C. 154(b) by 197 days.

(21) Appl. No.: 10/509,118

(22) PCT Filed: Apr. 4, 2003

(86) PCT No.: PCT/KR03/00675

§ 371 (c)(1),
(2), (4) Date: Sep. 28, 2004

(87) PCT Pub. No.: WO03/087447

PCT Pub. Date: Oct. 23, 2003

(65) Prior Publication Data

US 2005/0158543 A1 Jul. 21, 2005

(30) Foreign Application Priority Data

| | | |
|---|---|---|
| Apr. 9, 2002 | (KR) | 10-2002-0019254 |
| Apr. 19, 2002 | (KR) | 10-2002-0021561 |
| Apr. 19, 2002 | (KR) | 10-2002-0021563 |
| Apr. 22, 2002 | (KR) | 10-2002-0021845 |
| May 16, 2002 | (KR) | 10-2002-0027088 |
| Oct. 30, 2002 | (KR) | 10-2002-0066432 |

(51) Int. Cl.
*D02G 3/02* (2006.01)

(52) U.S. Cl. ..... 57/210; 57/227

(58) Field of Classification Search ..... 57/210, 57/227, 231, 244–246, 284, 289
See application file for complete search history.

(56) References Cited

U.S. PATENT DOCUMENTS

| | | | | |
|---|---|---|---|---|
| 5,379,501 | A | 1/1995 | Goineau | |
| 5,802,836 | A * | 9/1998 | Curran et al. | 57/351 |
| 6,038,847 | A | 3/2000 | Jen | |
| 2003/0037530 | A1* | 2/2003 | Zhu | 57/246 |
| 2003/0089098 | A1* | 5/2003 | Bodmer | 57/245 |

FOREIGN PATENT DOCUMENTS

| | | | |
|---|---|---|---|
| EP | 0 352 376 | A | 1/1990 |
| JP | 8-60466 | A | 3/1996 |
| JP | 10-158947 | A | 6/1998 |
| JP | 2000-290846 | A | 10/2000 |
| KR | 96-23349 | A | 7/1996 |

* cited by examiner

*Primary Examiner*—Shaun R. Hurley
(74) *Attorney, Agent, or Firm*—Birch, Stewart, Kolasch & Birch, LLP

(57) ABSTRACT

The present invention relates to a textured yarn (ATY) with different shrinkage and excellent suede effect, wherein at least one or two kinds of two-component composite yarn (effect) yarn having a monofilament fineness are twined around a thermoplastic multifilament yarn (core yarn), forming loops on the surface of the textured yarn.

28 Claims, 5 Drawing Sheets

TEXTURED YARN WITH DIFFERENT SHRINKAGE AND EXCELLENT SUEDE EFFECT AND METHOD FOR PREPARING THE SAME

TECHNICAL FIELD

The present invention relates to a textured yarn with different shrinkage which is superior in the effect of exhibiting a natural leather-like touch and appearance (hereinafter, 'suede effect') and can selectively exhibit the effect of mixing various colors in dyeing (hereinafter, 'melange effect'), and a method for preparing the same.

Synthetic fibers with superior physical properties have been used as yarns for apparel for a long time along with natural fibers. But, the synthetic fibers are problematic in that they have a cold touch and is not soft.

As a method for giving a natural fiber-like soft touch to synthetic fibers, the development of ultra fine synthetic fibers having a monofilament fineness of less than 1.0 denier has been carried out. Since the ultra fine synthetic fibers have a touch and function of higher quality than natural fibers, are easily processed, are easy to handle with, and is capable of mass production at low cost, so their range of use becomes wider and wider.

BACKGROUND ART

Typically, methods for preparing a ultra fine synthetic fiber include a direct spinning method and a conjugated spinning method.

In the direct spinning method, since a fiber is directly spun through a spinneret, it is difficult to produce a ultra fine fiber of less than 0.1 denier, and a number of problems occur in a yarn finishing and weaving step.

In contrast, in the conjugated spinning method, a two-component composite yarn is prepared by conjugated-spinning different polymers such as a polyester/polyamide composition or a polyester/copolymer polyester, and thereafter monofilaments (hereinafter, 'fibrils') of a fiber forming component are prepared by being separated and divided from the two-component composite yarn by a physical or chemical treatment in a post-processing process. Therefore, the method is advantageous in that it is easy to produce a ultra fine fiber of less than 0.1 denier, the fiber is easily conjugated with other fibers and the yarn finishing and weaving processability are good since fibrils are separated and divided in the post-processing process.

However, in case of solely using the two-component composite yarn, which is prepared by the conjugated spinning method, in woven or knitted fabrics, the buffability, volume property, drape property and bursting strength are reduced. Particularly, in case of conjugated spinning the polyester/copolymerized polyester composition, because the copolymerized polyester is extracted by weight reduction, a space is generated between fabric weaves and thus significantly degrading the resulting fabrics in volume property, drape property and bursting strength.

To solve the above problem occurred by solely using the ultra fine synthetic fiber or the two-component composite fiber, a method for conjugating the ultra fine synthetic fiber and other fibers has been widely studied.

As the prior art for conjugating a two-component composite fiber and other fibers, Korean Patent Laid-Open No. 1998-55564 and the same No. 1999-24801 disclose methods, as shown in FIG. 2, in which a two-component composite fiber(C) of an undrawn state is drawn and false-twisted, then is fed into an air texturing nozzle(14) at the same overfeed rate (approximately 1 to 5%) along with a high shrinkage yarn(D), and then they are simply tangled (air-interminglied) by an air pressure of 1 to 5 kgf/cm$^2$.

In the present invention, such a interminglied yarn with different shrinkage is hereinafter defined as 'ITY (interlaced yarn)', which is prepared by simply interlacing a core yarn and an effect yarn in the air texturing nozzle under the condition that the core yarn and the effect yarn has the same overfeed rate of less than 5% and an air pressure is less than 5 kgf/cm$^2$, and, as shown in FIG. 4, which consists of the core yarn and the effect yarn simply interlaced at an irregular interval along the lengthwise direction of the yarn. Specifically, as shown in FIG. 4, the ITY has a structure consisting of a compacted portion(b) and a bulky portion(C) formed alternately along the lengthwise direction of the yarn.

The interlaced yarn(ITY) with different shrinkage prepared by the above method has an advantage that it shows an excellent bulkiness due to a difference in shrinkage between the bulky ultra fine fiber and the high shrinkage yarn. And the ITY shows excellent strength and drape property due to thick monofilaments of the high shrinkage yarn used as the core yarn. However, in the above method, since an undrawn, two-component composite yarn that is weak in physical property is solely drawn and false-twisted, the process stability is significantly reduced under a common false twisting condition, and it is impossible to get a textured yarn with excellent bulkiness.

For instance, in case of drawing and false-twisting a two-component composite yarn having polyester as a fiber forming component and copolymerized polyester as an extraction component, since the thermal stability of the copolymerized polyester used as the extraction component decreases, it is inevitable to set a temperature lower than a typical heating temperature, and an enough number of false-twist (twist/unit length) cannot be given.

As the result, the prepared textured yarn with different shrinkage is greatly lowered in bulkiness, that is, crimp ratio(CR %). The crimp ratio is a representative physical property representing the bulkiness and quality of the yarn in the post-processing. Due to the lower crimp ratio, the ultra fine fiber is not sufficiently raised on the surface of the yarn, thus failing in getting the fabrics of excellent quality.

In Japanese Patent Laid-Open No. H7-126951, a method is described wherein a thermoplastic multifilament yarn (core yarn) and a low shrinkage, two-component composite yarn (effect yarn) are respectively fed into an air texturing nozzle at the same overfeed rate (approximately 1 to 5%), and then are simply interlaced (air-interminglied) by an air pressure of 1 to 5 kgf/cm$^2$, thereby preparing a interminglied yarn(ITY) with different shrinkage.

However, the ITYs prepared by the conventional methods are different in length simply because of the difference in thermal behavior property between two yarns, so they cannot show a good suede effect in the production of woven or knitted fabrics since the dispersabilty of fibrils is lowered though the bulkiness is expressed. More specifically, as shown in FIG. 4, the interminglied yarns with different shrinkage (ITYs) prepared in the conventional methods has the shape where fibrils are simply compacted at a constant interval along the lengthwise direction of the intermingled yarn.

As a result, the concentrated fibrils are not dispersed well after producing a woven or knitted fabric, the length of raised fibers in interminglied (concentrated) portion are different from the length of raised fibers in non-interminglied (unconcentrated) portion and density of the raised fiber is irregular. By this, in the production of woven or knitted fabric, as shown in FIG. 6, raised fibers aggregate to partially expose the bottom of the woven or knitted fabric, and a superior suede effect cannot be shown.

As another conventional method, a method is widely embodied wherein a thermoplastic multifilament (core yarn) and, not a two-component composite yarn, but an ordinary low shrinkage multifilament yarn (effect yarn), are fed into an air texturing nozzle at a different overfeed rate (approximately 5 to 50%), and then are air-textured by a high air pressure of 6 to 16 kgf/cm$^2$, thereby preparing a textured yarn with different shrinkage.

In the present invention, such a textured yarn with different shrinkage is hereinafter defined as 'ATY (air-textured yarn)', which is prepared by air-texturing a core yarn and an effect yarn in the air texturing nozzle under the condition that the core yarn and the effect yarn has a different overfeed rate of 5 to 50% and an air pressure ranges from 6 to 16 kgf/cm$^2$, and, as shown in FIG. 3, in which the effect yarn twines around the core yarn and loops(a) of the effect yarn are formed on the surface of the textured yarn.

For the thusly prepared ATY, as shown in FIG. 3, although loops are formed on the surface of the textured yarn, because the effect yarn forming the loops is not a two-component composite yarn, namely, a ultra fine fiber, the raised fiber density is low and the fibril dispersion is not occurred in the production of woven or knitted fabric, thereby failing in exhibiting a suede effect.

Accordingly, the present invention has been made keeping in mind the above problems occurring in the prior art, and an object of the present invention is to provide a textured yarn with different shrinkage (ATY) which can exhibit a superior touch and appearance in the production of woven or knitted fabric because it has a superior fibril dispersability, a high raised fiber density and a uniform raised fiber length after a buffing process.

Another object of the present invention is to provide a textured yarn with different shrinkage which shows an excellent melange effect when being dyed.

A further object of the present invention is to provide a method for preparing a textured yarn with different shrinkage which shows an excellent suede effect.

DISCLOSURE OF INVENTION

The present invention provides a textured yarn with different shrinkage which shows an excellent suede effect in the production of woven or knitted fabrics since it consists of a two-component composite yarn (effect yarn) and a thermoplastic multifilament yarn (core yarn) being air-textured under a proper condition, the effect yarn being twined around the core yarn, and uniform loops of the two-component composite yarn are formed on the surface of the textured yarn.

In order to accomplish the above objects, the present invention provides a method for preparing a textured yarn with different shrinkage by air-texturing an effect yarn and a core yarn, wherein at least one or two kinds of two-component composite yarn having a monofilament fineness of 0.001 to 0.3 denier after dividing or extracting an extraction component is used as the effect yarn, a thermoplastic multifilament yarn is used as the core yarn, the overfeed ratio of effect yarn to core yarn is set to 1.2 to 4.0 and an air pressure is set to 6 to 16 kgf/cm$^2$.

The thusly prepared textured yarn(ATY) with different shrinkage is characterized in that; at least one or two kinds of two-component composite yarn(effect yarn) having a monofilament fineness of 0.001 to 0.3 denier after dividing or extracting an extraction component is twined around a thermoplastic multifilament yarn(core yarn), 2 to 350 loops per meter of the two-component composite yarn of at least 1.0 mm in length are formed on the surface of the textured yarn, and more than 95% of the two-component composite yarn loops of at least 1.0 mm in length have a length of 1.0 to 2.5 mm.

Hereinafter, the present invention will be described in detail with reference to the accompanying drawings.

In the present invention, as shown in FIG. 1, at least one or two kinds of two-component composite yarn having a monofilament fineness of 0.001 to 0.3 denier after or dividing or extracting an extraction component is used as an effect yarn(A) and a thermoplastic multifilament yarn is used as a core yarn(B), the effect yarn and the core yarn are respectively fed into an air texturing nozzle 3 through a first feed roller 1 and a second feed roller 2 so that the overfeed ratio of effect yarn to core yarn is ranged between 1.2 and 4.0, and then they are air-textured by an air pressure of 6 to 16 kgf/cm$^2$, thereby preparing for a texture yarn with different shrinkage.

It is more preferable that the core yarn(B) is smeared with moisture by a water supply device 4 prior to being fed into the air texturing nozzle 3.

The overfeed rate of the effect yarn is set by a difference in linear velocity between the first feed roller 1 and the third feed roller 5, and the overfeed rate of the core yarn is set by a difference in linear velocity between the second feed roller 2 and the third feed roller 5.

The textured yarn with difference shrinkage textured in the air texturing nozzle 3 is heat-treated in a hollow heater 6 and thereafter is wound around a take-up roller 8.

If the monofilament fineness of the thermoplastic multifilament yarn(core yarn) is lower than 1 denier, the drape property of woven or knitted fabrics is reduced.

If the monofilament fineness of the thermoplastic multifilament yarn(core yarn) is exceedingly higher than 8 deniers, the yarn processibility is reduced and the repulsive elasticity is significantly increased, thus resulting in poor sewing processibility and degrading the quality of fabrics. Therefore, the monofilament fineness of the thermoplastic multifilament yarn(core yarn) is preferably 1 to 8 denier.

Additionally, if the shrinkage rate at boiling water of the thermoplastic multifilament yarn(core yarn) is lower than 5%, a difference in thermal shrinkage rate between the core and effect yarns is small and therefore the bulkiness and compactness are reduced, thus making it difficult to get the resulting fabrics of excellent touch and appearance of fabrics. If exceedingly higher than 50%, wrinkles are formed on the fabrics due to an excessive shrinkage and the weaves becomes excessively compact, thus hardening the fabrics and making the length of raised fibers uneven.

Therefore, the shrinkage rate at boiling water of the thermoplastic multifilament yarn(core yarn) is preferably 5 to 50%. This is because the difference in thermal shrinkage rate between the core and effect yarns is related to the bulkiness and compactness of the resulting fabrics.

If the elongation of the thermoplastic multifilament yarn (core yarn) is lower than 25%, the yarn processability and the yarn finishing property may be lowered. If exceedingly higher than 45%, the drape property of the fabric may be reduced. Thus, the elongation of the thermoplastic multifilament yarn(core yarn) is preferably 25 to 45%.

To produce such a thermoplastic high shrinkage multifilament yarn(core yarn), a method is preferable wherein polyester polymer is copolymerized with the third component.

The third component includes dicarboxyl acids such as sebacic acid, phthalic acid, isophthalic acid, etc., glycols such as diethylene glycol, polyethylene glycol, neopentyl glycol, etc, bisphenol A, bisphenol sulfon and the like.

Considering the exhibition of the high shrinkage properties, the content of copolymer in the third component is preferably higher than 3 mol %. If the copolymer content is too high, the spinning properties are degraded and the fabrics become poor due to excessive shrinkage. Thus, the copolymer content of lower than 20 mol % is most preferable.

The melting point temperature on a DSC changes according to the content of copolymer in the third component. If the melting point temperature of the high shrinkage yarn(core yarn) of the present invention is lower than 220° C., the process stability may be poor due to the thermal instability. If exceedingly higher than 240° C., the thermal shrinkage rate may be lowered. Therefore, the melting point temperature of the high shrinkage yarn(core yarn) is more preferably 220 to 240° C. under scanning rate of 20° C./min.

Meanwhile, the two-component composite yarn(effect yarn) consists of a fiber forming component and an extraction component or consists of at least two kinds of fiber forming components with different dyeing properties, and therefore the monofilament fineness after dividing or extracting the extraction component is 0.001 to 0.3 denier. The fiber forming component and the extraction component can be conjugated into a sea-island type or a division type. The two-component composite yarn of the present invention includes all common composite fibers consisting of a fiber forming component and an extraction component.

In addition, in the present invention, in order to obtain a mélange effect in a dyeing process, (i) a two-component composite yarn is used as the effect yarn, which consists of at least two kinds of fiber forming components with different dyeing properties; or (ii) at least two kinds of two-component composite yarns are simultaneously used, each consisting of a fiber forming component and an extraction component, the fiber forming component having different dyeing properties from each other.

More specifically, (i) a two-component composite yarn is used as the effect yarn, which consists of a fiber forming component of polyester and a fiber forming component of polyamide each having different dyeing properties from each other and being conjugated side by side; or (ii) a two component composite yarn consisting of a polyester fiber forming component and an extraction component and a two-component composite yarn consisting of a polyamide fiber forming component and an extraction component are simultaneously used as the effect yarn.

If the monofilament fineness of the fiber forming component after dividing or extracting the extraction component is exceedingly higher than 0.3 denier, it fails to get a suede fabric with excellent touch. If the monofilament fineness is lower than 0.001 denier, the yarn processibility, lightfastness and washfastness are reduced though the touch becomes superior.

The shrinkage rate at boiling water of the two-component composite yarn(effect yarn) is preferably lower than 15%. If the shrinkage rate at boiling water is exceedingly higher than 15%, a difference in shrinkage rate between the effect and core yarns becomes smaller and therefore the bulkiness and compactness of the fabrics are reduced, thus degrading the quality of the fabrics.

Additionally, if the elongation of the two-component composite yarn(effect yarn) is lower than 23%, the yarn processibility and the yarn finishing properties are reduced. If the elongation is exceedingly higher than 45%, the toughness is increased and therefore the buffability is reduced and the evenness of raised fibers becomes poor. Thus, the elongation of the two-component composite yarn(effect yarn) is more preferably 23 to 45%.

The fiber forming component includes polyester resin, polybutylene terephthalate resin, polyamide resin and the like, and an additive such as carbon black may be added to the resin. The extraction component includes copolymerized polyester that is copolymerized with isophthalate and/or polyalkylene glycol.

As the two-component composite yarn, a yarn prepared by the spin direct draw process, a drawn yarn that is prepared by drawing an undrawn yarn and a false-twisted yarn that is prepared by false-twisting a drawn yarn are all included. In addition, the two-component composite yarn may be a thick-and-thin yarn that is prepared by non-uniformly drawing an undrawn yarn.

FIG. 1 is one example of an apparatus for producing a textured yarn with different shrinkage according to the present invention. An effect yarn(A) and a core yarn(B) are respectively fed into feed rollers 1 and 2 with different overfeed rate, and the effect yarn(A) and the core yarn(B) passing over the feed rollers are air-textured in an air texturing nozzle.

The reason why the core and effect yarns are fed into different feed rollers is to position the core yarn(B) at the center of the textured yarn and make the effect yarn(A) floating on the surface of the textured yarn in loop(a) shape as shown in FIG. 3 by making the overfeed rate of the effect and core yarns different.

At this time, the overfeed rate of the effect yarn is set to 10 to 60% and the overfeed rate of the core yarn is set to 5 to 55%. If the overfeed rate of the effect yarn is too low, loops are not formed on the surface of the textured yarn and therefore, as in the conventional art, the effect and core yarns simply have an air textured shape, thereby reducing the quality when applied to woven or knitted fabrics. If the overfeed rate of the core yarn is too high, the yarn finishing processability may be reduced and the weavability may be reduced due to a large amount of long loops on the surface of the textured yarn.

The overfeed rate of the effect and core yarns is determined by the rotary linear velocity ratio of the first and second feed rollers 1 and 2 to the third feed roller 5. Namely, the overfeed rate of the effect and core yarns exceeding 0% means that the rotary linear velocity of the first and second feed rollers 1 and 2 is higher than that of the third feed roller 5.

At this time, the rotary linear velocity of the first and second rollers 1 and 2 is preferably set to 200 to 600 m/min. If the rotary linear velocity is exceedingly higher than 600 m/min, the length of time where the effect and core yarns are touched with air during air texturing becomes smaller, thereby making the loop shape poor and degrading the yarn finishing properties due to an increase in tension caused by high-speed traveling. Therefore, the lower the rotary linear velocity, the better the loops of uniform density are formed on the textured yarn with different shrinkage. But, if too low, the productivity is decreased.

Prior to feeding the core yarn into the air texturing nozzle 3, more specifically, a water supply device 4 located between the second feed roller 2 and the air texturing nozzle 3 supplies a sufficient quantity of water to the core yarn. At this time, it is more preferable to use the water which is deionized and does not contain bivalent inorganic salt such as bivalent calcium, bivalent magnesium, etc.

At this time, if the overfeed ratio of effect yarn/core yarn overfeed rate is lower than 1.2, the core yarn as well as the effect yarn rises on the surface as loops to thus make the touch poor. If the overfeed ratio is higher than 4.0, there is a risk that the loops on the surface of the textured yarn may be non-uniform. Thus, the overfeed ratio of effect yarn/core yarn is preferably set to 1.2 to 4.0.

Meanwhile, the air pressure by which the core and effect yarns are air-textured is set to 6 to 16 kgf/cm$^2$. If the air pressure is lower than 6 kgf/cm$^2$, the loops(a) of the two-component composite yarn(effect yarn) are not formed on the surface of the textured yarn(ATY) with different shrinkage as shown in FIG. 3, but the effect and core yarns simply have the shape of being non-uniformly textured along the lengthwise direction of the textured yarn with different shrinkage, thereby decreasing a suede effect in the production of woven or knitted fabrics as shown in FIG. 4. If the air pressure is higher than 16 kgf/cm$^2$, the effect and core yarns are damaged by an excessive air pressure, thereby degrading the physical properties of the textured yarn(ATY) with different shrinkage.

If the weight ratio of the two-component composite yarn used as the effect yarn to the thermoplastic multifilament yarn used as the core yarn is lower than 0.8, the ratio of the thermoplastic multifilament yarn(core yarn) becomes higher, thereby increasing the possibility of the core yarn rising as raised fibers. If the weight ratio is higher than 6.0, the overall shrink force of the core yarn is reduced, thereby making the bulkiness poor. Therefore, the weight ratio of effect yarn/core yarn is more preferably 0.8 to 6.0.

Next, the textured yarn with different shrinkage that is air-textured as seen from above is heat-treated in a hollow heater 6 and then is wound. In the above heat treatment, the overfeed rate is set to 0 to −8% and the temperature is set to 130 to 210° C.

In the above heat treatment, the overfeed rate is determined by the rotary linear velocity ratio of the third feed roller 5 to the fourth feed roller 7. Namely, the overfeed rate of a minus value lower than 0% during the heat treatment means that the rotary linear velocity ratio of the fourth feed roller 7 is higher than that of the third feed roller 5.

The loops on the textured yarn air-textured in the air texturing nozzle 3 are thermally and physically in an unstable state, they need to be stabled. If the heat treatment temperature is lower than 130° C., the yarn is not sufficiently heat-treated and therefore the loops are changed during a dyeing treatment, thus reducing the quality of the fabrics. If the heat treatment temperature is higher than 210° C., the hardness is increased due to excessive heat treatment, thus failing to obtain the fabrics of soft touch.

Further, in the heat treatment, if the overfeed rate is lower than −8%, the tension is increased and therefore the loops formed during air texturing are lost. This reduces the bulkiness, increases the glossiness and increases oriented crystallization, thereby making the dyeing properties poor. Moreover, in the heat treatment, if the overfeed rate is higher than 0%, the yarn traveling properties are reduced due to a low tension, yarn cutting is increased because the yarns are touched to the surface of the hollow heater, and quality problems such as scorching is occurred.

The thusly heat-treated textured yarn with different shrinkage is wound under the condition that the overfeed rate ranges from −2% to −12%. If the overfeed rate is higher than −2%, the hardness of the yarns wound around a paper tube is lowered and the compactness of the yarns is weakened, thereby causing the yarn layers to be collapsed when being woven at a high speed. On the other hand, if the overfeed rate is lower than −12%, the hardness of the yarns wound around the paper tube is increased, the wound state becomes poor and the compactness of the yarns is strengthened, thereby reducing the yarn separating properties in a weaving process.

In the above winding process, the overfeed rate is determined by the rotary linear velocity of the third feed roller 5 and take-up roller 8. Namely, the overfeed rate of a minus value lower than 0% during the winding means that the rotary linear velocity of the take-up roller 8 is higher than that of the third feed roller 5.

The thusly prepared textured yarn(ATY) with different shrinkage according to the present invention has a structure that at least one or two kinds of two-component composite yarn(effect yarn), consists of a fiber forming component and an extraction component or consists of at least two kinds of fiber forming components, having a monofilament fineness of 0.001 to 0.3 denier after dividing or extracting the extraction component is twined around a thermoplastic multifilament yarn(core yarn), 2 to 350 loops per meter of the two-component composite yarn of at least 1.0 mm in length are formed on the surface of the textured yarn, and more than 95% of the two-component composite yarn loops of at least 1.0 mm in length has a length of 1.0 to 2.5 mm.

In case that the total fineness of the textured yarn(ATY) with different shrinkage is lower than 100 denier, it is more preferable that 2 to 50 loops of the two-component composite yarn are formed per meter.

Specifically, the textured yarn(ATY) with different shrinkage consists of a thermoplastic multifilament yarn as a core portion and a two-component composite yarn as an effect portion. At the center of the textured yarn(ATY) with different shrinkage, relatively more thermoplastic multifilament yarns are distributed and, at an outer part thereof, relatively more two-component composite yarn are distributed as a large quantity of loops. This leads to an excellent bulkiness and, when adapted to the fabrics, a large quantity of uniform fibrils can be completely dispersed after weight reduction and extraction. As a result, in the production of woven or knitted fabrics, a suede effect of excellent touch and compact structure is expressed.

For the conventional interlaced yarns(ITY) with different shrinkage as shown in FIG. 4, although it is possible to acquire the fabrics with bulkiness due to a difference in yarn length caused by the difference in thermal shrinkage between the core yarn and the effect yarn, the division and opening of fibrils are not properly achieved after weight reduction and extraction and therefore the raised fibers are aggregated, thus failing to acquire the fabrics of fine touch and making the appearance poor.

In order to solve such a problem, however, the present invention prepares a suede-like woven or knitted fabric having a superior touch which maximizes the difference in bulkiness between a core yarn and an effect yarn when weaving the woven or knitted fabric and improves the density and evenness of raised fibers by not simply mixing a high shrinkage yarn and a low shrinkage two-component composite yarn, but positively projecting the two-component composite yarn from the surface of a textured yarn (ATY) with different shrinkage in loop shape.

The textured yarn(ATY) with different shrinkage of the present invention having a large quantity of loops may be deteriorated in processibility by the loops when being adapted to woven or knitted fabrics. In order to obtain the processibility and excellent quality, the loop length and number are very important.

The textured yarn(ATY) with different shrinkage of the present invention has 2 to 350 loops per meter of the two-component composite yarn of at least 1.0mm in length. If the loop number is lower than two per meter, it is impossible to obtain a high quality due to a decrease in bulkiness. If the loop number is higher than 350 per meter, the processibility and weavability become poor due to a large friction force during yarn traveling.

Additionally, in order to obtain good processibility and weavability and obtain the fabrics with uniform raised fibers, the loop length is also important. At least 95% of the loops of 1.0 mm in length formed on the textured yarn(ATY) with different shrinkage of the present invention have a length of 1.0 to 2.5 mm. If there are a lot of loops higher than 2.5 mm in length, the friction force is increased to thus reduce the processibility. Also, after being adapted to woven or knitted fabrics, the length of the raised fibers becomes non-uniform, thus failing to obtain the fabrics of superior quality.

Further, the textured yarn(ATY) of the present invention has a strength of 1.5 to 3.0 g per denier and an evenness (U %) of 0.5 to 1.0. Moreover, the strength of the textured yarn(ATY) with different shrinkage after dividing or extracting the extraction component is increased by 5 to 30% with respect to the strength prior to dividing or extracting then extraction component and the number of loops on the surface of the textured yarn(ATY) with different shrinkage is increased 8 to 170 times.

The above-described textured yarn(ATY) with different shrinkage of the present invention is used as a warp and/or weft and is woven or knitted according to an ordinary method into a woven fabric, warp knit fabric or circular knit fabric (hereinafter, referred to as 'woven or knitted fabric'). Then, the woven or knitted fabric is heat-treated to thus exhibit a shrinkage difference, the fibrils are divided through alkali weight reduction, raised fibers are formed through a process such as fiber raising or buffing, and then a final product is produced by dyeing, chemical treatment and thermalsetting.

In case that the textured yarn(ATY) with different shrinkage of the invention is used in fabrics, it is possible to obtain a high-quality fabric even if the yarn is used for either the warp or the weft without being used for both warp and weft. The thusly obtained woven or knitted fabric is superior to the conventional woven or knitted fabrics in dispersability of fibrils, density of raised fibers and evenness of raised fibers.

By comparison between FIG. 5, a photograph of the surface of the fabric obtained in Example 1 of the present invention, and FIG. 6, a photograph of the surface of the fabric obtained in Comparative Example 1 of the conventional art, it is known that the fabric of the present invention has a superior quality because it has a higher density of raised fibers than a conventional fabric.

In the present invention, various physical properties and characteristics of yarns and woven or knitted fabrics are evaluated by the following method.

Rupture Elongation (%) and Rupture Strength (g/d)

The rupture elongation and the rupture strength are measured using Instron Model 4201 according to ASTM D 2556 method Under a standard condition (20° C.×65% RH).

Shrinkage Rate at Boiling Water (%)

The shrinkage rate at boiling water is measured according to JIS-L 1037-5-12.

Evenness (U %)

Using a Uster Evenness Tester, type C, measurement is carried out for one minute under the condition: a yarn speed of 25 m/min, a gauge range of ±12.5% and a chart speed of 5 cm/min. Then, the evenness (U %) is evaluated.

Rate of Increment of Strength of Textured Yarn with Different Shrinkage after Weight Reduction with Respect to Strength Prior to Weight Reduction The rupture strength(X) of the textured yarn with different shrinkage prior to weight reduction and the rupture strength (Y) of the textured yarn with different shrinkage after weight reduction in a NaOH solution of 1% at 95° C. are respectively measured. Then, the measured values are substituted into the following formula for calculation.

$$\text{Rate of increment of strength of textured yarn with different shrinkage(\%)} = \frac{(Y-X)}{X} \times 100$$

Length and Number of Loops

Measuring is carried out by Fray Counter Model DT-104 (manufactured by Toray Industries, Inc.) for one minute at a speed of 60 m/min as stated in International Fiber Journal, December 1993, pp. 5–10. Specifically, the number(X) of loops of at least 1.0 mm in maximum height (hereinafter, 'loop length') projecting from the surface of the textured yarn is measured by the above mentioned measuring instrument, and then the number(Y) of loops of at least 2.5 mm in loop length is measured by the above measuring instrument. The measured values are substituted in the following formula and the ratio of loops of 1.0 to 2.5 mm in length is obtained with respect to the loops of at least 1.0 m in length.

$$\text{Ratio (\%) of loops of 1.0 to 2.5 mm in length/loops of at least 1.0 mm in length} = \frac{X-Y}{X} \times 100$$

As for a mechanism for measuring a length of loops, using a yarn guide equipped with a micrometer, the textured yarn with different shrinkage is traveled in a constant direction and light is passed at a right angle to in the traveling direction. When the shades of loops higher than a set value appear on a screen board, the current flowing in an optical transistor bonded to the back of a pin hole is amplified to an electric signal. Thus, the number of loops is measured by being automatically counted by a counter.

Drape Property/Softness/Evenness of Raised Fibers/Mélange Effect

An organoleptic test is conducted by 10 panelists. A five-point method is carried out where the average point more than 4 is excellent, the average point between 3.9 and 3.0 is good and the point less than 2.9 is bad.

BRIEF DESCRIPTION OF THE DRAWINGS

These and other features, aspects, and advantages of preferred embodiments of the present invention will be more fully described in the following detailed description, taken accompanying drawings. In the drawings.

Figure 1:
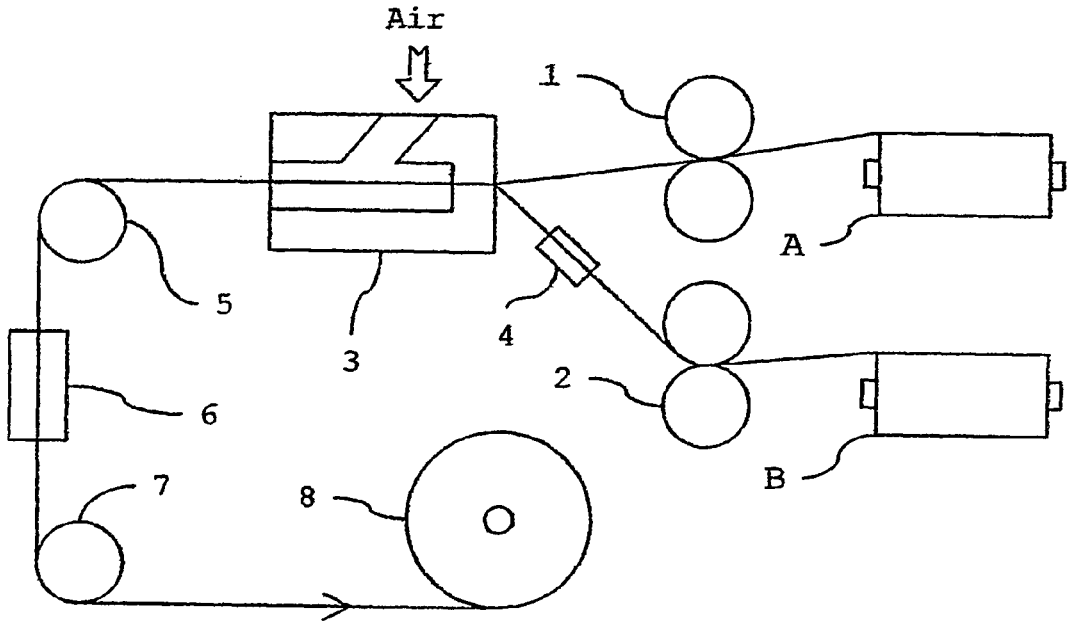
FIG. 1 is a schematic view of an air-texturing process according to the present invention.

※ Explanation of reference numerals for main parts in drawings.

A: low shrinkage, two-component composite yarn (effect yarn)

B: thermoplastic multifilament yarn (core yarn)

C: highly-orientated, undrawn two-component composite yarn (effect yarn)

D: High shrinkage yarn(core yarn)

a: loop portion of textured yarn with different shrinkage of the present invention b: compact portion of conventional intermingled yarn (ITY) with different shrinkage c: bulky portion of conventional intermingled yarn(ITY) with different shrinkage

| | |
|---|---|
| 1, 10: first feed roller | 2, 13: second feed roller |
| 3, 14: air texturing nozzle | 4: water supply device |
| 5, 15: third feed roller | 6: hollow heater |
| 7: fourth feed roller | 8, 16: take-up roller |
| 11: hot plat | 12: false-twisting unit |

BEST MODES FOR CARRYING OUT THE INVENTION

Hereinafter, the present invention will be described in more detail with reference to Examples and Comparative Examples. But, the present invention is not limited to the following Examples.

EXAMPLE 1

As a fiber forming component, polyethylene terephthalate with an intrinsic viscosity of 0.66 is used and, as a soluble component, copolymerized polyester with an intrinsic viscosity of 0.58 is used which is obtained by copolymerizing polyethylene terephthalate with sulfo isophthalic acid of 2.5 mol % and polyethylene glycol of 10 weight %. The two kinds of polymers are respectively melted, spun at a spinning temperature of 290° C. and at a spinning speed of 1,200 m/min using a conjugated spinneret pack, and then drawn by a common method at a drawing ratio of 3.3 times, thereby preparing a two-component composite yarn of 120 deniers/48 filaments with a shrinkage rate at boiling water of 8%. Meanwhile, copolymerized polyethylene terephthalate with an intrinsic viscosity of 0.66, which is prepared by copolymerizing polyethylene terephthalate with a third copolymer component, that is, isophthalic acid of 10 mol %, is melted at 280° C., spun at a spinning speed of 1,450 m/min, and then drawn 2.9 times at 90° C., thereby preparing a thermoplastic multifilament yarn of 30 deniers/12 filaments with a shrinkage rate at boiling water of 23%. The thusly prepared two-component composite yarn is fed as an effect yarn into an air texturing nozzle (Hebrain T-311) at an overfeed rate of 38% and at the same the thusly prepared thermoplastic multifilament yarn is fed as a core yarn into the air texturing nozzle at an overfeed rate of 16%. They are air-textured by an air pressure of 12 kgf/cm$^2$, thermally set in a hollow heater 6 at 180° C. in a state that the overfeed rate is −3%, and then wound under the condition that the overfeed rate is −8%, thereby preparing a textured yarn(ATY) with different shrinkage. An 8-sheet satin weave fabric is woven using the textured yarn(ATY) as a weft and thereafter scoured, alkali weight-reduced, dyed, heat-set, raised and buffed under a common condition, thereby preparing a suede woven fabric. The evaluation results of the physical properties of the textured yarn(ATY) with different shrinkage and woven fabric thus obtained are stated as in Table 2.

EXAMPLES 2 TO 5

A textured yarn(ATY) with different shrinkage and a suede woven fabric are prepared by the same procedure as in Example 1 except that the copolymer content of isophthalic acid, the shrinkage rate at boiling water of the core yarn, the overfeed rate of the core yarn and the overfeed rate of the effect yarn are changed as in Table 1. The evaluation results of the physical properties of the textured yarn(ATY) with different shrinkage and woven fabric thus obtained are stated as in Table 2.

TABLE 1

| | Condition of Preparation | | | | |
|---|---|---|---|---|---|
| | Copolymer content (mol %) | Shrinkage rate (%) at | | Overfeed rate (%) | |
| Classification | of isophthalic acid | boiling water of core yarn | Air pressure (kgf/cm$^2$) | Core yarn | Effect yarn |
| Example 1 | 10 | 23 | 12 | 16 | 38 |
| Example 2 | 0 | 8 | 12 | 16 | 38 |
| Example 3 | 12 | 30 | 12 | 16 | 38 |
| Example 4 | 10 | 23 | 10 | 10 | 22 |
| Example 5 | 10 | 23 | 14 | 35 | 55 |

EXAMPLE 6

Figure 2:
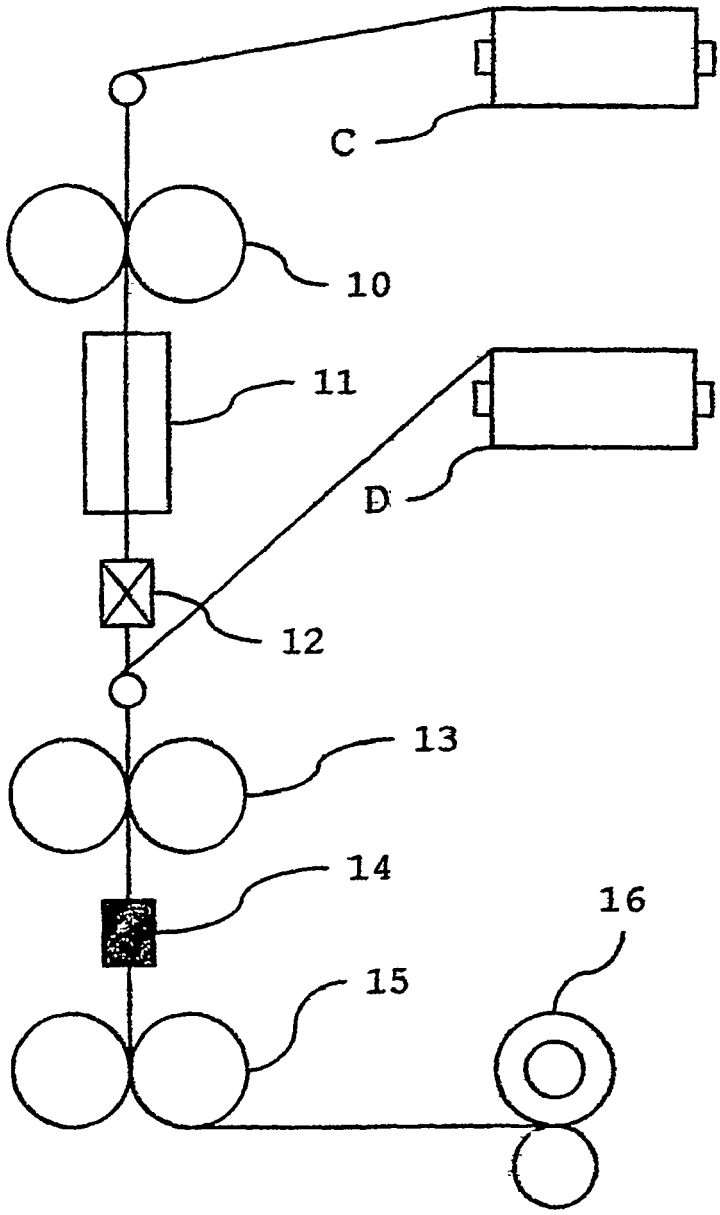
FIG. 2 is a schematic view of a conventional false-twist texturing process.
Figure 3:
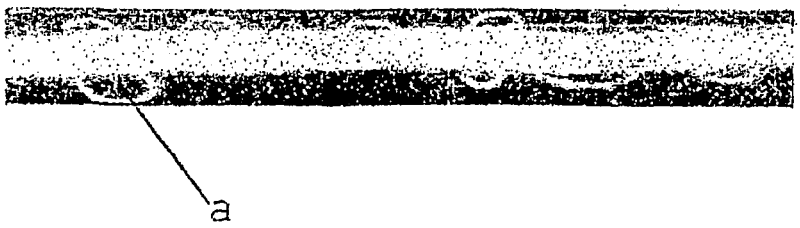
FIG. 3 is an electron micrograph of a textured yarn(ATY) with different shrinkage according to the present invention.
Figure 4:
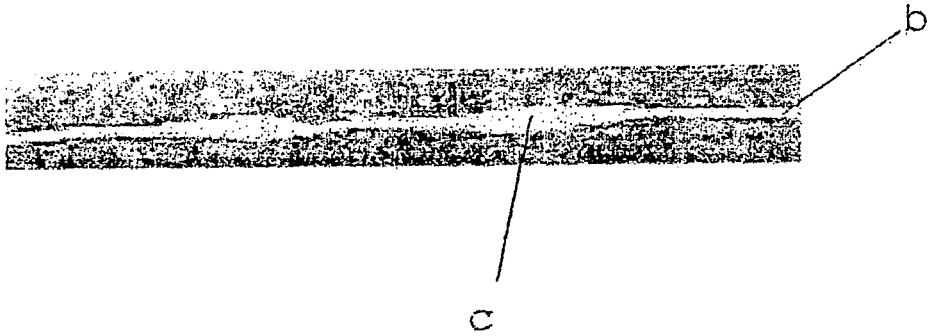
FIG. 4 is an electron micrograph of a conventional intermingled yarn(ITY) with different shrinkage.
Figure 5:
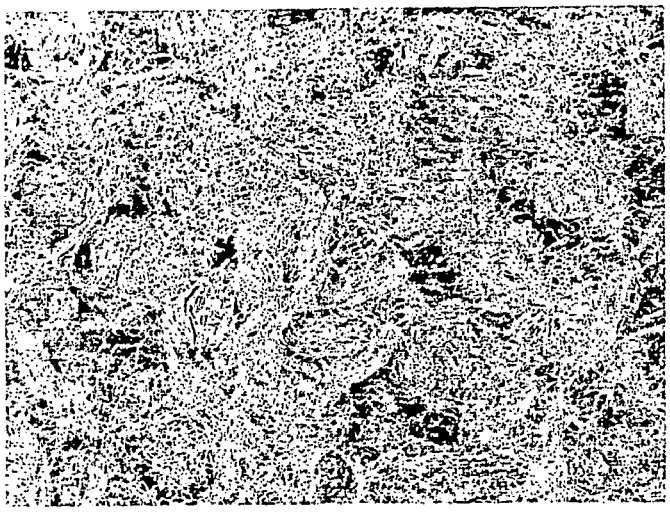
FIG. 5 is an electron micrograph of the surface of a fabric woven from the textured yarn(ATY) with different shrinkage according to the present invention.
Figure 6:
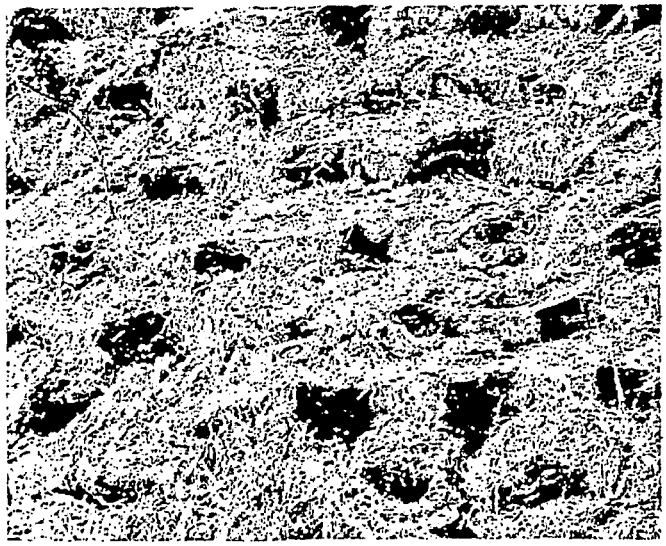
FIG. 6 is an electron micrograph of the surface of a fabric woven from the conventional intermingled yarn(ITY) with different shrinkage.
Figure 7:
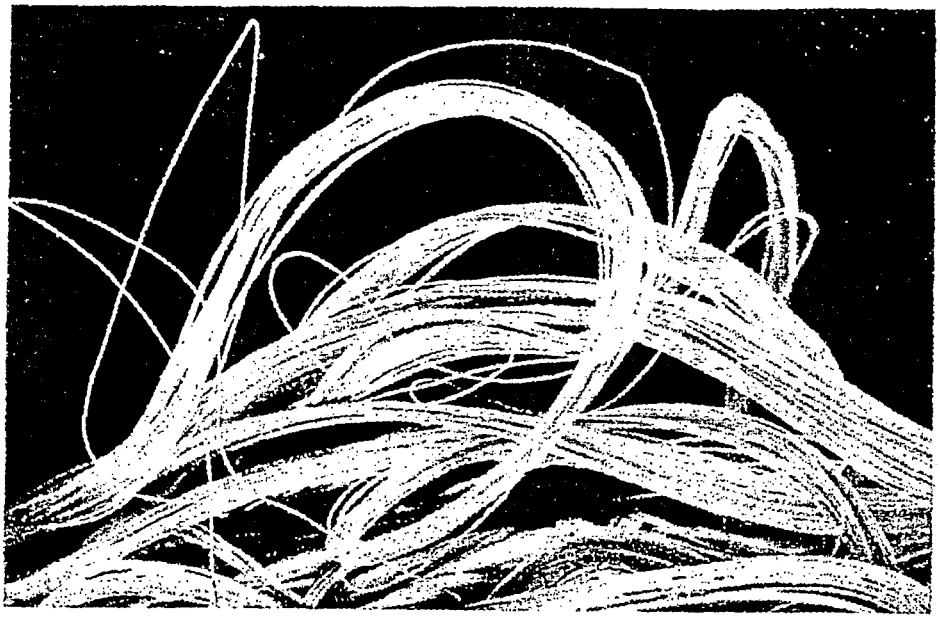
FIG. 7 is an electron micrograph of the textured yarn (ATY) with different shrinkage after weight reduction according to the present invention.
Figure 8:
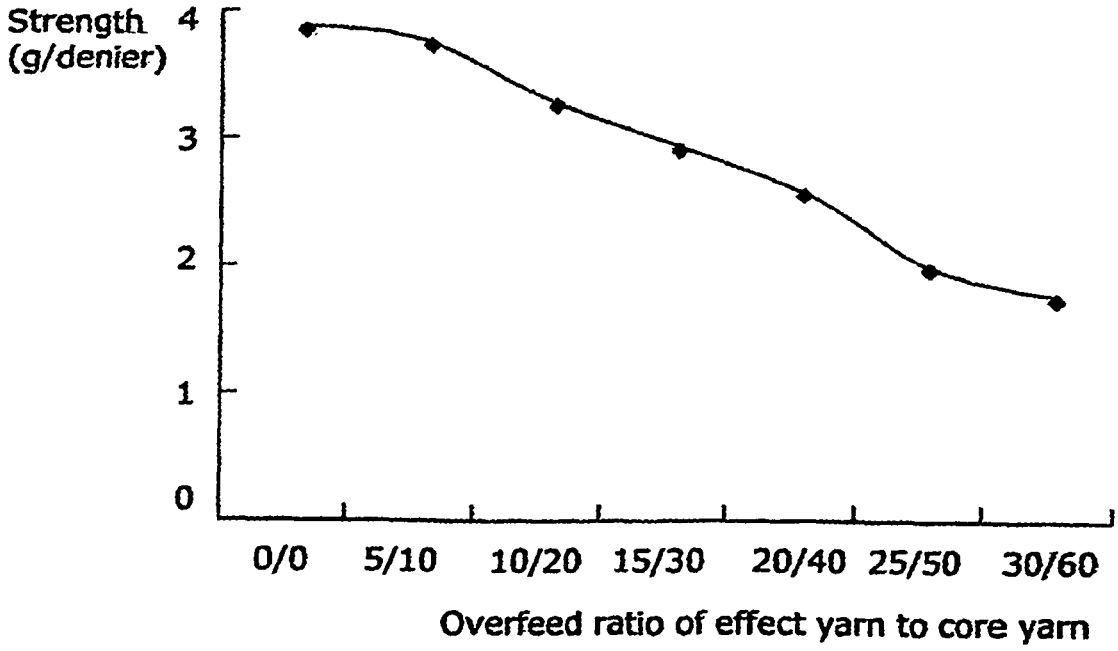
FIG. 8 is a strength curve of the textured yarn(ATY) with different shrinkage of the present invention according to an overfeed rate.
Figure 9:
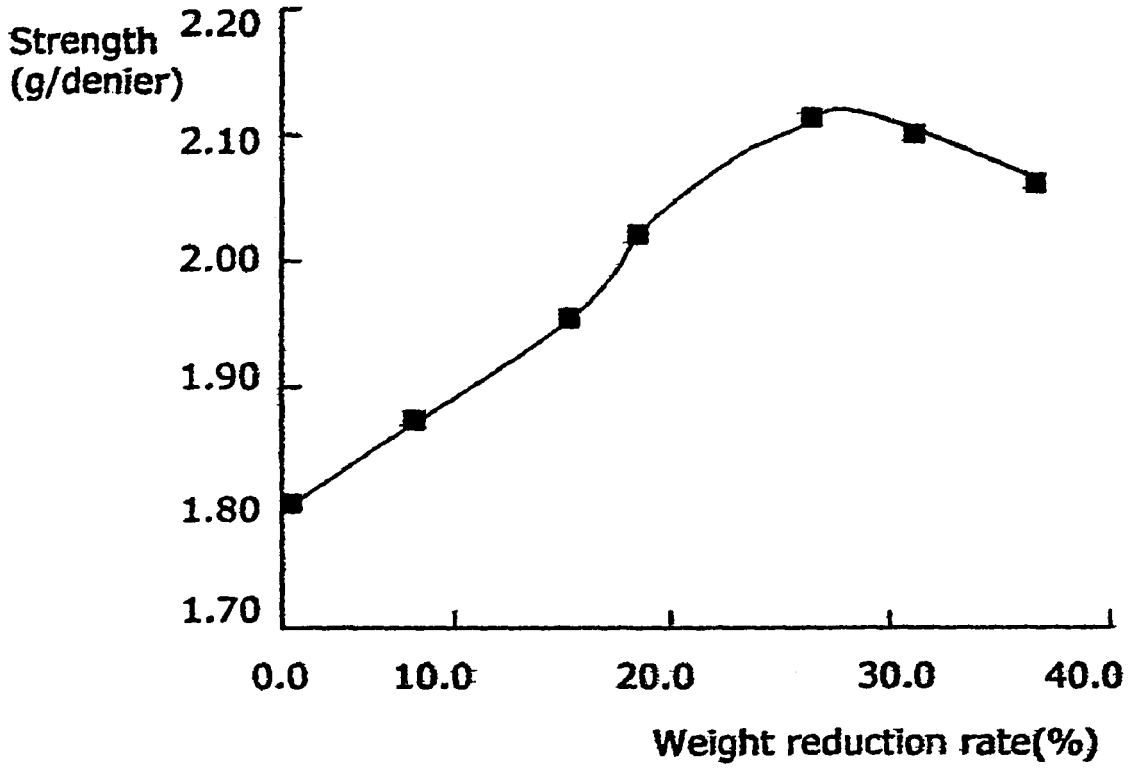
FIG. 9 is a strength curve of the textured yarn(ATY) with different shrinkage of the present invention according to a weight reduction rate.

As a fiber forming component, polyethylene terephthalate with an intrinsic viscosity of 0.66 is used and, as a soluble component, copolymer polyester with an intrinsic viscosity of 0.58 is used which is obtained by copolymerizing polyethylene terephthalate with sulfo isophthalic acid of 2.5 mol % and polyethylene glycol of 10 weight %. The two kinds of polymers are respectively melted, spun at a spinning temperature of 290° C. and at a spinning speed of 3,200 m/min using a conjugated spinneret pack, thereby preparing a highly-oriented, undrawn yarn of 200 deniers/48 filaments. Thereafter, the prepared yarn is drawn by a common method in a complex false twister (hot plate: 150° C.) of FIG. 2, thereby preparing a false-twist yarn of 120 deniers/48 filaments with a shrinkage rate at boiling water of 6%. Meanwhile, copolymerized polyethylene terephthalate with an intrinsic viscosity of 0.66, which is prepared by copolymerizing polyethylene terephthalate with the third copolymer component, that is, isophthalic acid of 10 mol %, is melted at 280° C., spun at a spinning speed of 1,450 m/min, and then drawn 2.9 times at 90° C., thereby preparing a thermoplastic multifilament yarn of 30 deniers/12 filaments with a shrinkage rate at boiling water of 23%. Then, the false-twist yarn and thermoplastic multifilament yarn thus obtained are air-textured by the same procedure and under the same condition as in Example 1, thereby preparing a textured yarn(ATY) with different shrinkage. An 8-sheet satin weave fabric is woven using the textured yarn(ATY) as a weft and thereafter scoured, alkali weight-reduced, dyed, heat-set, raised and buffed under a common condition, thereby preparing a suede woven fabric. The evaluation results of the physical properties of the textured yarn(ATY) with different shrinkage and woven fabric thus obtained are stated as in Table 2.

EXAMPLE 7

As a fiber forming component, polyethylene terephthalate with an intrinsic viscosity of 0.66 is used and, as a soluble component, copolymer polyester with an intrinsic viscosity of 0.58 is used which is obtained by copolymerizing polyethylene terephthalate with sulfo isophthalic acid of 2.5 mol % and polyethylene glycol of 10 weight %. The two kinds of polymers are respectively melted, spun at a spinning temperature of 290° C. and at a spinning speed of 1,200 m/min using a conjugated spinneret pack, and then drawn by a common method at a drawing ratio of 3.3 times, thereby preparing a two-component composite yarn of 120 deniers/48 filaments with a shrinkage rate at boiling water of 8%. Meanwhile, as a fiber forming component, polyamide with a relative viscosity of 2.50 is used and, as a soluble component, copolymerized polyester with an intrinsic viscosity of 0.58 is used which is obtained by copolymerizing polyethylene terephthalate with sulfo isophthalic acid of 2.5 mol % and polyethylene glycol of 10 weight %. The two kinds of polymers are respectively melted, spun at a spinning temperature of 280° C. and at a spinning speed of 1,200 m/min using a conjugated spinneret pack, and then drawn by a common method at a drawing ratio of 3.3 times, thereby preparing a two-component composite yarn of 120 deniers/48 filaments with a shrinkage rate at boiling water of 6%. Meanwhile, copolymerized polyethylene terephthalate with an intrinsic viscosity of 0.66, which is prepared by copolymerizing polyethylene terephthalate with a third copolymer component, that is, isophthalic acid of 10 mol %, is melted at 280° C., spun at a spinning speed of 1,450 m/min, and then drawn 2.9 times at 90° C., thereby preparing a thermoplastic multifilament yarn of 30 deniers/12 filaments with a shrinkage rate at boiling water of 23%. The two kinds of two-component composite yarns thus obtained are simultaneously fed as an effect yarn into an air texturing nozzle (Hebrain T-311) at an overfeed rate of 38% and at the same the thusly prepared thermoplastic multifilament yarn is fed as a core yarn into the air texturing nozzle at an overfeed rate of 16%. They are air-textured by an air pressure of 12 kgf/cm$^2$ and thermally set in a hollow heater 6 at 180° C. in a state that the overfeed rate is −4%, and then wound under the condition that the overfeed rate is −7%, thereby preparing a textured yarn(ATY) with different shrinkage. An 8-sheet satin weave fabric is woven using the textured yarn(ATY) as a weft and thereafter scoured, alkali weight-reduced, dyed, heat-set, raised and buffed under a common condition, thereby preparing a suede woven fabric. The evaluation results of the physical properties of the textured yarn(ATY) with different shrinkage and woven fabric thus obtained are stated as in Table 2.

EXAMPLE 8

As a fiber forming component, polyethylene terephthalate with an intrinsic viscosity of 0.66 and polyamide with a relative viscosity of 2.50 are used. The two kinds of polymers are respectively melted, spun at a spinning temperature of 290° C. and at a spinning speed of 1,200 m/min using a conjugated spinneret pack, and then drawn by a common method at a drawing ratio of 3.0 times, thereby preparing a two-component composite yarn of 120 deniers/48 filaments with a shrinkage rate at boiling water of 6%. Meanwhile, polyethylene terephthalate with an intrinsic viscosity of 0.66 is melted at 290° C., spun at a spinning speed of 1,450 m/min, and then drawn 2.9 times at 110° C., thereby preparing a thermoplastic multifilament yarn of 30 deniers/12 filaments with a shrinkage rate at boiling water of 7%. Then, the thus obtained two-component composite yarn used as an effect yarn and the thus obtained thermoplastic multifilament yarn used as a core yarn are air-textured by the same procedure and under the same condition as in Example 1, thereby preparing a textured yarn(ATY) with different shrinkage. An 8-sheet satin weave fabric is woven using the textured yarn(ATY) as a weft and thereafter scoured, alkali weight-reduced, dyed, heat-set, raised and buffed under a common condition, thereby preparing a suede woven fabric. The evaluation results of the physical properties of the textured yarn(ATY) with different shrinkage and woven fabric thus obtained are stated as in Table 2.

COMPARATIVE EXAMPLE 1

As a fiber forming component, polyethylene terephthalate with an intrinsic viscosity of 0.66 is used and, as a soluble component, copolymerized polyester with an intrinsic viscosity of 0.58 is used which is obtained by copolymerizing polyethylene terephthalate with sulfo isophthalic acid of 2.5 mol % and polyethylene glycol of 10 weight %. The two kinds of polymers are respectively melted, spun at a spinning temperature of 290° C. and at a spinning speed of 3,200 m/min using a conjugated spinneret pack, thereby preparing a highly-oriented, undrawn yarn of 200 deniers/48 filaments. Thereafter, the prepared yarn is false twisted by a common method in a complex false twister (hot plate: 150° C.) of FIG. 2, thereby preparing a false-twist yarn of 120 deniers/48 filaments with a shrinkage rate at boiling water of 6%. Meanwhile, copolymerized polyethylene terephthalate with an intrinsic viscosity of 0.66, which is prepared by copolymerizing polyethylene terephthalate with a third copolymer component, that is, isophthalic acid of 10 mol %, is melted at 280° C., spun at a spinning speed of 1,450 m/min, and then drawn 2.9 times at 90° C., thereby preparing a thermoplastic multifilament yarn of 30 deniers/12 filaments with a shrinkage rate at boiling water of 23%. Then, the false-twist yarn and thermoplastic multifilament yarn thus obtained are interlaced (intermingled) in the complex false twister under the condition that the overfeed rate is 2.5% and the air pressure is 3.5 kgf/cm$^2$, thereby preparing an intermingled yarn(ITY) with different shrinkage. An 8-sheet satin weave fabric is woven using the intermingled yarn (ITY) as a weft and thereafter scoured, alkali weight-reduced, dyed, heat-set, raised and buffed under a common condition, thereby preparing a suede woven fabric. The evaluation results of the physical properties of the intermingled yarn(ITY) with different shrinkage and woven fabric thus obtained are stated as in Table 2.

COMPARATIVE EXAMPLE 2

As a fiber forming component, polyethylene terephthalate with an intrinsic viscosity of 0.66 is used and, as a soluble component, copolymerized polyester with an intrinsic viscosity of 0.58 is used which is obtained by copolymerizing polyethylene terephthalate with sulfo isophthalic acid of 2.5 mol % and polyethylene glycol of 10 weight %. The two kinds of polymers are respectively melted, spun at a spinning temperature of 290° C. and at a spinning speed of 1,200 m/min using a conjugated spinneret pack, and then drawn by a common method at a drawing ratio of 3.3 times, thereby preparing a two-component composite yarn of 120 deniers/48 filaments with a shrinkage rate at boiling water of 6%. Meanwhile, copolymerized polyethylene terephthalate with an intrinsic viscosity of 0.66, which is prepared by copolymerizing polyethylene terephthalate with a third copolymer component, that is, isophthalic acid of 10 mol %, is melted at 280° C., spun at a spinning speed of 1,450 m/min, and then drawn 2.9 times at 90° C., thereby preparing a thermoplastic multifilament yarn of 30 deniers/12 filaments with a shrinkage rate at boiling water of 23%. The thusly prepared two-component composite yarn is fed as an effect yarn into an air texturing nozzle at an overfeed rate of 3% and at the same the thusly prepared thermoplastic multifilament yarn is fed as a core yarn into the air texturing nozzle at an overfeed rate of 3%. They are interlaced (intermingled) by an air pressure of 3.5 kgf/cm$^2$, thereby preparing an intermingled yarn(ITY) with different shrinkage. An 8-sheet satin weave fabric is woven using the intermingled yarn(ITY) as a weft and thereafter scoured, alkali weight-reduced, dyed, heat-set, raised and buffed under a common condition, thereby preparing a suede woven fabric. The evaluation results of the physical properties of the intermingled yarn(ITY) with different shrinkage and woven fabric thus obtained are stated as in Table 2.

COMPARATIVE EXAMPLE 3

Copolymerized polyethylene terephthalate with an intrinsic viscosity of 0.66, which is prepared by copolymerizing polyethylene terephthalate with a third copolymer component, that is, isophthalic acid of 10 mol %, is melted at 280° C., spun at a spinning speed of 1,450 m/min, and then drawn 2.9 times at 90° C., thereby preparing a thermoplastic multifilament yarn of 30 deniers/12 filaments with a shrinkage rate at boiling water of 23%. The thusly prepared thermoplastic multifilament yarn is fed as a core yarn into an air texturing nozzle (Hebrain T-311) at an overfeed rate of 16% and at the same a polyester multifilament yarn of 120 deniers/48 filaments with a shrinkage rate at boiling water of 8% is fed as an effect yarn into the air texturing nozzle at an overfeed rate of 30%. They are air-textured by an air pressure of 10 kgf/cm$^2$, thereby preparing a textured yarn (ATY) with different shrinkage. An 8-sheet satin weave fabric is woven using the textured yarn(ATY) as a weft and thereafter scoured, alkali weight-reduced, dyed, heat-set, raised and buffed under a common condition, thereby preparing a suede woven fabric. The evaluation results of the physical properties of the textured yarn(ATY) with different shrinkage and woven fabric thus obtained are stated as in Table 2.

TABLE 2

Physical properties of textured yarn and fabric

| Classification | | Example 1 | 2 | 3 | 4 | 5 | 6 | 7 | 8 | Comparative Example 1 | 2 | 3 |
|---|---|---|---|---|---|---|---|---|---|---|---|---|
| Physical properties of textured yarn with different shrinkage | Number of loops between 1.0 and 2.5 mm | 112 | 109 | 111 | 65 | 256 | 72 | 162 | 125 | 0 | 0 | 87 |
| | Number of loops higher than 2.5 mm | 1 | 0 | 1 | 0 | 9 | 0 | 4 | 0 | 0 | 0 | 5 |
| | Rate (time) of Increment of surface loops after weight reduction | 36 | 36 | 36 | 36 | 36 | 36 | 36 | 36 | — | — | 3 |
| | Strength (g/d) Before weight reduction | 1.8 | 2.6 | 3.2 | 2.6 | 1.6 | 2.4 | 1.8 | 2.6 | 2.8 | 3.8 | 3.6 |
| | Strength (g/d) After weight reduction | 2.0 | 2.9 | 3.4 | 3.1 | 1.9 | 3.0 | 2.0 | 2.9 | 2.7 | 3.7 | 3.6 |
| | U % | 0.61 | 0.72 | 0.85 | 0.71 | 0.92 | 0.57 | 0.80 | 0.72 | 0.63 | 0.45 | 0.42 |
| Physical properties of fabric | Drape property | Excellent | Good | Excellent | Good | Excellent | Excellent | Excellent | Excellent | Bad | Bad | Bad |
| | Softness | Excellent | Excellent | Excellent | Good | Excellent | Excellent | Excellent | Excellent | Bad | Bad | Bad |
| | Evenness of raised fibers | Excellent | Good | Excellent | Excellent | Good | Excellent | Excellent | Excellent | Bad | Bad | Bad |
| | Mélange effect | Bad | Bad | Bad | Bad | Bad | Bad | Excellent | Excellent | Bad | Bad | Bad |

INDUSTRIAL APPLICABILITY

The textured yarn(ATY) with different shrinkage of the present invention exhibits a good touch and appearance since the monofilament dispersability of the two-component composite yarn is superior, the density of the raised fibers is high and the length of the raised fibers is uniform in the production of woven or knitted fabrics. Thus, the textured yarn(ATY) with different shrinkage is useful as yarns for apparel. Additionally, the method for preparing the textured yarn(ATY) with different shrinkage of the present invention is simplified in its procedure and is improved in processibility since a process for false-twisting the two-component composite yarn can be omitted.

The invention claimed is:

1. A textured yarn(ATY) with different shrinkage and excellent suede effect, wherein at least one or two kinds of two-component composite yarn(effect yarn) having a monofilament fineness of 0.001 to 0.3 denier after dividing or extracting an extraction component are twined around a thermoplastic multifilament yarn(core yarn), 2 to 350 loops per meter of the two-component composite yarn of at least 1.0 mm in length are formed on the surface of the textured yarn, and more than 95% of the two-component composite yarn loops of at least 1.0 mm in length has a length of 1.0 to 2.5 mm.

2. The textured yarn of claim 1, wherein the shrinkage rate at boiling water of the two-component composite yarn(effect yarn) is 0 to 15%.

3. The textured yarn of claim 1, wherein the shrinkage rate at boiling water of the thermoplastic multifilament yarn(core yarn) is 5 to 50%.

4. The textured yarn of claim 1, wherein 2 to 50 loops per meter of the two-component composite yarn of at least 1.0 mm in length are formed on the surface of the textured yarn.

5. The textured yarn of claim 1, wherein the monofilament fineness of the thermoplastic multifilament yarn(core yarn) 1 to 8 denier.

6. The textured yarn of claim 1, wherein the two-component composite yarn(effect yarn) consists of at least two kinds of fiber forming components with different dyeing properties.

7. The textured yarn of claim 1 or 6, wherein the two-component composite yarn(effect yarn) consists of a fiber forming component of polyester and a fiber forming component of polyamide.

8. The textured yarn of claim 1, wherein the two-component composite yarn(effect yarn) consists of a fiber forming component and an extraction component.

9. The textured yarn of claim 1 or 8, wherein the fiber forming component and extraction component in the two-component composite yarn(effect yarn) are conjugated into a sea-island type or division type.

10. The textured yarn of claim 1, wherein the effect yarn comprises at least two kinds of two-component composite yarns, each consisting of a fiber forming component and an extraction component, the fiber forming component having different dyeing properties from each other.

11. The textured yarn of claim 1 or 10, wherein the effect yarn comprises: (i) a two-component composite yarn consisting of a polyester fiber forming component and an extraction component; and (ii) a two-component composite yarn consisting of a polyamide fiber forming component and an extraction component.

12. The textured yarn of claim 1, wherein the strength of the textured yarn(ATY) with different shrinkage is 1.5 to 3.5 g/denier.

13. The textured yarn of claim 1, wherein the evenness(U %) of the textured yarn(ATY) with different shrinkage is 0.5 to 1.0.

14. The textured yarn of claim 1, wherein the strength of the textured yarn(ATY) with different shrinkage after dividing or extracting the extraction component is increased by 5 to 30% with respect to the strength prior to dividing or extracting then extraction component.

15. The textured yarn of claim 1, wherein the number of loops on the surface of the textured yarn(ATY) with different shrinkage is increased 8 to 170 times with respect to the number prior to dividing or extracting then extraction component.

16. A method for preparing a textured yarn(ATY) with different shrinkage and excellent suede effect by air-texturing an effect yarn and core yarn, wherein at least one or two kinds of two-component composite yarn(A) is fed as the effect yarn into an air texturing nozzle(3) at an over feed rate of 10 to 60% through the first feed roller(1), the two-component composite yarn(A) consisting of a fiber forming component and an extraction component or consisting of at least two kinds of fiber forming components and having a monofilament fineness of 0.001 to 0.3 denier after dividing or extracting the extraction component, at the same time, a thermoplastic multifilament yarn(B) is fed as the core yarn into the air texturing nozzle(3) at an overfed rate of 5 to 55% through the second feed roller(2) while supplying water to a water supply device(4) disposed between the second feed roller(2) and the air texturing nozzle(3), and then the effect and core yarns are air-textured by an air pressure of 6 to 16 $kgf/cm^2$ in the air texturing nozzle(3), heat-treated at a temperature of 130 to 210° C. in a hollow heater(6) in a state that the overfeed rate is 0 to −8% and wound in a state that the overfeed rate is −2 to −12%.

17. The method of claim 16, wherein the elongation of the core yarn is 25 to 45%.

18. The method of claim 16, wherein the elongation of the effect yarn is 23 to 45%.

19. The method of claim 16, wherein the two-component composite yarn(effect yarn) consists of at least two kinds of fiber forming components having different dyeing properties from each other.

20. The method of claim 16 or 19, wherein the two-component composite yarn(effect yarn) consists of a polyester fiber forming component and a polyamide fiber forming component.

21. The method of claim 16, wherein the two-component composite yarn(effect yarn) consists of a fiber forming component and an extraction component.

22. The method of claim 16, wherein the effect yarn includes at least two kinds of two-component composite yarns, each consisting of a fiber forming component and an extraction component, the fiber forming component having different dyeing properties from each other.

23. The method of claim 16 or 22, wherein the effect yarn comprises: (i) at least one two-component composite yarn consisting of a polyester fiber forming component and an extraction component; and (ii) at least one two-component composite yarn consisting of a polyamide fiber forming component and an extraction component.

24. The method of claim 16, wherein the rotary linear velocity of the first feed roller(1) and second feed roller(2) is 200 to 600 m/min.

25. The method of claim 16, wherein the water supplied to the core yarn by the water supply device(4) is deionized.

26. A woven fabric woven from the textured yarn with different shrinkage of claim 1.

27. A circular knit fabric knitted from the textured yarn with different shrinkage of claim 1.

28. A warp knit fabric knitted from the textured yarn with different shrinkage of claim 1.

* * * * *